United States Patent [19]

Tsai

[11] Patent Number: 5,045,188

[45] Date of Patent: Sep. 3, 1991

[54] RECIRCULATING TOILET WATER SYSTEM WITH SELF-PURGING VALVE OPERABLE BY A RESTORING SPRING

[76] Inventor: Irwin Y. Tsai, P.O. Box 10160, Taipei, Taiwan

[21] Appl. No.: 494,566

[22] Filed: Mar. 16, 1990

[51] Int. Cl.[5] ..... E03D 5/16

[52] U.S. Cl. ..... 210/136; 4/318; 4/321; 210/167; 210/410; 210/411

[58] Field of Search ..... 4/317, 318, 321, 359, 4/362, DIG. 19; 137/110, 513.3, 517, 521, 538, 542; 210/136, 167, 355, 411, 425, 798, 410

[56] References Cited

U.S. PATENT DOCUMENTS

| | | | |
|---|---|---|---|
| 3,501,778 | 3/1970 | Minniear et al. | 4/317 |
| 3,538,517 | 11/1970 | Cornish et al. | 210/317 |
| 3,567,032 | 3/1971 | Kemper | 210/355 |
| 3,634,891 | 1/1972 | Kemper | 4/317 |
| 3,751,735 | 8/1973 | Sargent et al. | 4/318 |
| 3,828,372 | 8/1974 | Cornish et al. | 4/318 |
| 4,083,067 | 4/1978 | Lieb et al. | 4/317 |
| 4,162,549 | 7/1979 | Charles et al. | 4/318 |

FOREIGN PATENT DOCUMENTS

| | | | |
|---|---|---|---|
| 17111 | 5/1907 | Fed. Rep. of Germany | 210/411 |

*Primary Examiner*—Robert A. Dawson
*Assistant Examiner*—Joseph Drodge

[57] ABSTRACT

A recirculating toilet water system includes: a toilet, a main water tank for storing water and receiving waste matters from the toilet, a filtered water supply means for supplying filtered water as filtered through a screen from the main water tank for flushing the toilet and an air supply means for delivering compressed air for boosting the filtered water for flushing the toilet, wherein the water supply means includes a feed water valve which is normally opened to fludically communicate a flushing water tank with the main water tank to lead water into the flushing water tank and is operatively closed when boosting the water for flushing the toilet by the compressed air, and is further provided with a purging perforation therethrough to eject a partial stream for purging the screen for preventing the clogging of particulate matters on the screen when boosting the water.

3 Claims, 2 Drawing Sheets

RECIRCULATING TOILET WATER SYSTEM WITH SELF-PURGING VALVE OPERABLE BY A RESTORING SPRING

BACKGROUND OF THE INVENTION

James M. Kemper disclosed a filter and pump for a recirculating sanitary system in his U.S. Pat. No. 3,567,032 having a diaphragm pump provided with a coupling to a plurality of needle members reciprocating through an apertured plate, which however has the following drawbacks:

1. If the air flowing through the flexible hose 46 to drive the internal diaphragm 48 is unidirectional and not reciprocative, the filter and pump assembly 30 must be made very large so that the enterred water volume pumped at one time will be enough to flush the toilet. Larger sanitary system is not suitable for a small aircraft or vehicle. If the pneumatic system is reciprocative, the filter and pump unit 30 may then be made smaller, which however may increase the installation cost and maintenance problem of a reciprocating pneumatic system since the reciprocating pneumatic mechanism is always more complex than a simple unidirectional compressed air supply system.

2. The diaphragm may be easily damaged or broken after repeated pumping operations to cause maintenance problems.

3. Even the needle members 80 may serve for expelling particulate matters during the boosting operation sequence. However, when the diaphragm 48 is restored by the return spring 56 to retract the rod member 58, the needle members 80 may also inwardly draft dirts accumulated thereon to possibly clog the apertures 78 and filtering spaces 82, thereby directing the dirts through the apertures 78 into the cup 66, chamber 52 to contaminate or clog other elements of the system. Meanwhile, the whole system is complex in structure and mechanism.

The present inventor has found the drawbacks of the conventional recirculating sanitary system and invented the present simpler recirculating toilet water system.

SUMMARY OF THE INVENTION

The object of the present invention is to provide a simple recirculating toilet water system including a toilet, a main water tank for storing water and receiving waste matters from the toilet, a filtered water supply means for supplying filtered water as filtered through a screen from the main water tank for flushing the toilet and an air supply means for delivering compressed air for boosting the filtered water for flushing the toilet, wherein the water supply means includes a feed water valve which is normally opened to fluidically communicate a flushing water tank with the main water tank to lead water into the flushing water tank and is operatively closed when boosting the water for flushing the toilet by the compressed air, and is further provided with a purging perforation therethrough to eject a partial stream for purging the screen for preventing the clogging of particulate matters on the screen when boosting the water.

DETAILED DESCRIPTIONS

Figure 1:
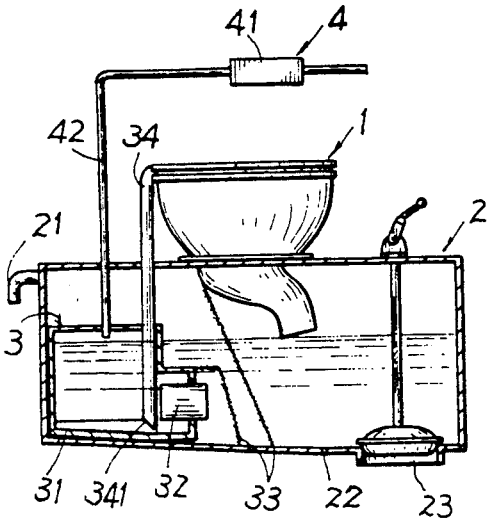
FIG. 1 is an illustration of the whole system of the present invention.
Figure 2:
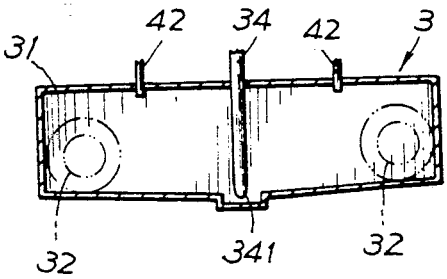
FIG. 2 is a partial side sectional drawing of the present invention.
Figure 3:
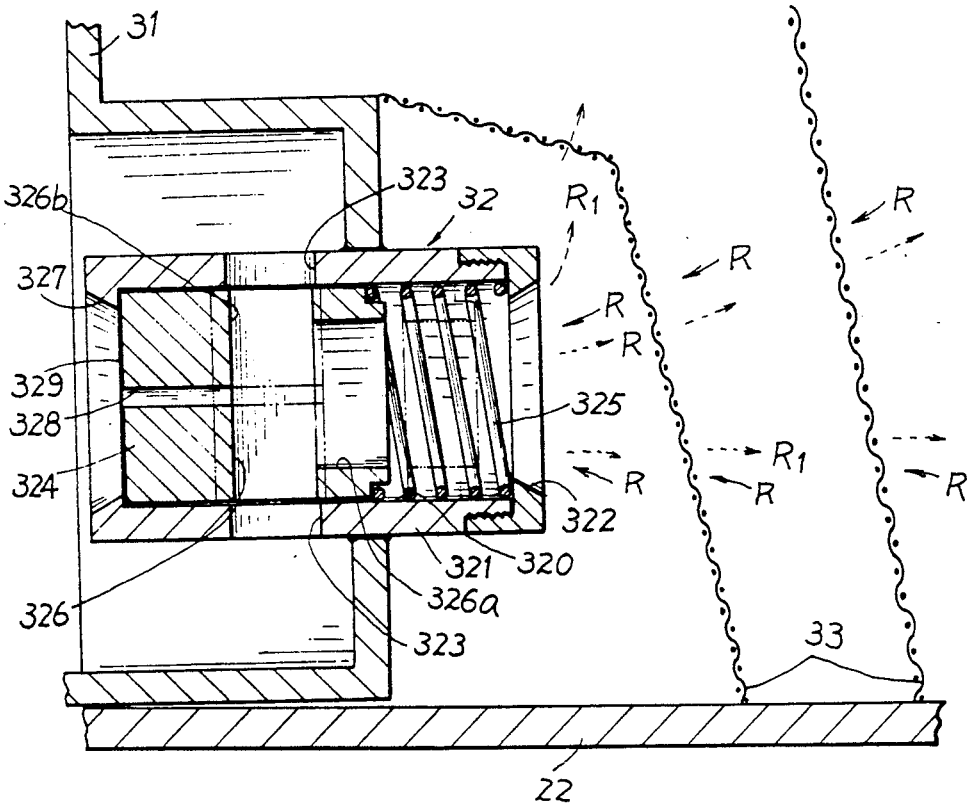
FIG. 3 shows a detailed construction of the filtered water supply means including the feed water valve of the present invention.

As shown in FIGS. 1-3, the present invention comprises: a toilet 1, a main water tank 2, a filtered water supply means 3 and an air supply means 4.

The main water tank 2 is positioned under the toilet 1 for receiving the waste matters discharged from the toilet 1 and is filled with water and sterilizing agent or deodorizing agent therein through conduits (not shown). A vent 21 is provided on a top portion of the tank for sucking the odor or gas outwardly and formed with a drain valve 23 in a bottom 22 of the tank 22 for waste disposal.

The filtered water supply means 3 includes: a flushing water tank 31 fixed in the main water tank 2, a feed water valve 32 formed in a lower portion of the tank 31, at least a screen 33 provided between the flushing water tank 31 and the main water tank 2 and a flushing pipe 34 connected to the toilet 1 having a lowest suction port 341 extending downwardly to approximate the bottom of the tank 31 as shown in FIG. 2. The screen 33 may be formed with fine mesh net or other filter materials for filtering off the particulate matters laden in the tank 2. The bottom of the flushing tank 31 is laid on the bottom 22 of tank 2. The screen 33 is provided beyond the feed water valve 32.

The air supply means 4 includes an air controller 41 which may be a control valve, a trigger for opening air supply or a timing device, and at least an air delivery pipe 42 leading a compressed air into the flushing water tank 31 as shown in FIGS. 1, 2. The compressed air may be unidirectional to boost the filtered water from the tank 31 to the toilet 1 for flushing the toilet 1.

The feed water valve 32 as shown in FIGS. 1, 3 includes: a valve body 321 generally shaped as a cylinder fixed in a lower portion of the flushing water tank 31 having a bore portion 320 in the body 321 and having a front inlet port 322 formed in a front end portion of the body 321 communicated with the main tank 2 and a rear purging port 327 formed in a rear end portion of the body 321 and at least a middle outlet port 323 formed in a middle portion of the valve body 321, both middle port 323 and rear port 327 being communicated with the flushing tank 31; a plunger 324 movably held in the bore portion 320 of the valve body 321 having a water passage 326 and at least a purging perforation 328 formed therein; and a restoring spring 325 retained between a front portion of the plunger 324 and a front portion of the valve body 321 proximate to the inlet port 322.

The water passage 326 in the plunger 324 has a cross section generally T shaped as shown in FIG. 3 having a longitudinal inlet hole **326*a* communicated with the inlet port 322 and a lateral hole 326*b* perpendicular to the longitudinal inlet hole 326*a* and normally communicated with the outlet port 323 radially formed in the valve body 321. The restoring spring 325 normally urges the plunger 324 rearwardly to be retained against a rear portion in the valve body 321 to match the water passage 326 with the outlet port 323 to normally fluidically communicate the flushing water tank 31 with the main water tank 2 until reaching an equal water level in both tanks 31, 2. The purging perforation 328 in the plunger 324 is always communicated with the rear port 327 and the front port 322 and has a cross sectional area greatly smaller than a cross sectional area of the flushing pipe 34. The rear port 327 is divergently enlarged rearwardly, whereas the front port 322 is divergently enlarged frontwardly for a smooth fluid flow therethrough. The plunger 324 further includes a solid rear portion 329 which operatively seals the outlet port 323 of the valve body 321 when subject to a boosting pressure for boosting water to flush the toilet 1 as shown in dotted line of FIG. 3**.

In using the present invention for flushing toilet 1, the controller 41 of the air supply means 4 is actuated to lead the compressed air into the flushing water tank 31 to boost water through the flushing pipe 34 to flush the toilet from which the flushed water and the waste matters are discharged into tank 2 for recirculating use as shown in FIG. 1. When the tank 31 is under boosting pressure by the compressed air from air supply means 4, the plunger 324 will be pressurized and pushed frontwardly to allow the solid portion 329 sealing the outlet port 323 so as to drive a main filtered water stream through the pipe 34 for flushing toilet 1, accompanied with a lowering of water level in the tank 31. Since the perforation 328 is so small in cross sectional area relative to the area of the pipe 34, a partial little stream is ejected through the plunger 324 to flush and expel the particulate matters accumulated on the screen 33 in direction R1 as shown in dotted line in FIG. 3, without influencing the major flushing stream through the pipe 34.

After the flushing operation is finished, the air supply is stopped and the pressure is released (such as from vent 21 or from the air supply system 4) so that the restoring spring 325 will urge the plunger 324 rearwardly to match the water passage 326 in plunger 324 with the outlet port 323 of the valve body 321 to open the valve 32. The flushed water in the tank 2 will then flow in direction R through screens 33 to be filtered therethrough and through port 322 of valve 32, passage 326 of plunger 324 and outlet port 323 of valve body 321, and finally flow into flushing water tank 31 until reaching an equal water level in both tanks 31, 2. The tapered port 322 will help a smooth input flow of filtered water into the tank 31. The tapered port 327 may help a smooth purging flow through the port 327, perforation 328 for cleaning the filtering screen 33.

Figure 4:
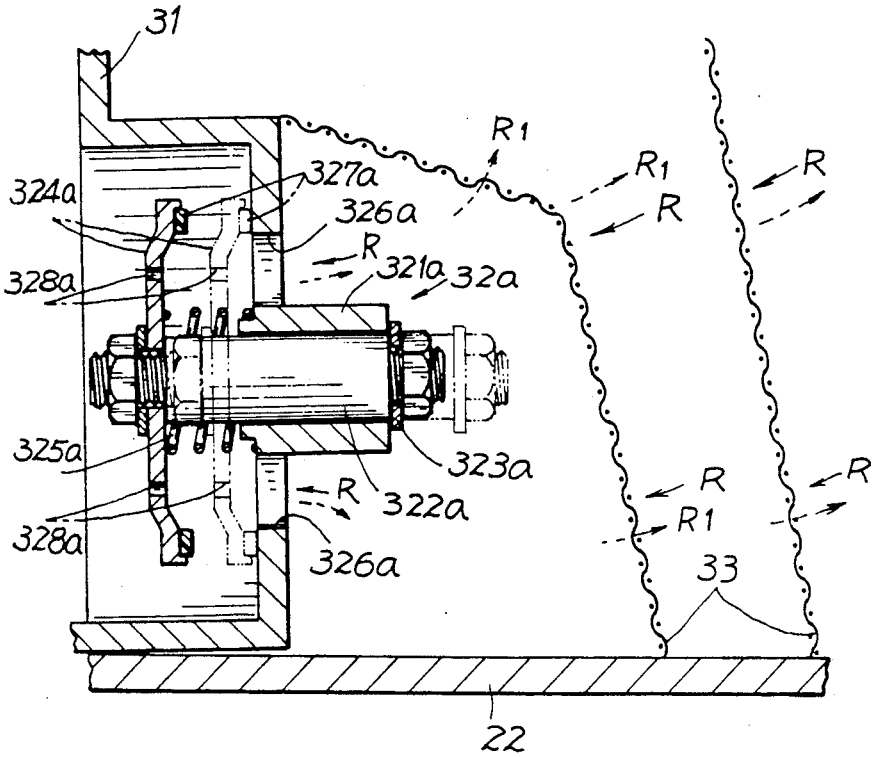
FIG. 4 shows another preferred embodiment of the feed water valve of the present invention.

Another preferred embodiment of the feed water valve 32 of the present invention is shown in FIG. 4, which includes: a valve body **321*a* generally formed as a cylindrical sleeve fixed in a lower portion of the flushing water tank 31, a valve stem 322*a* reciprocatively held in the cylindrical sleeve of the valve body 321*a*, a valve disc 324*a* secured on a rear end of the stem 322*a* having at least a purging perforation 328*a* formed therein and a packing member 327*a* formed on a periphery of the disc 324*a* for sealing an inlet port 326*a* formed in the tank wall when closing the valve 32*a*, a washer 323*a* fixed on an outer end of the stem 322*a* for limiting a rearward movement of the stem 322*a* and disc 324*a*, and a restoring spring 325*a* urging the disc 324*a* rearwardly for normally opening the valve 32*a***.

For flushing the toilet 1, the air is boosted to pump filtered water through pipe 34 for flushing toilet 1 and the disc **324*a* will be moved frontwardly under the boosting pressure to close the port 326*a* disposed around the cylindrical sleeve of valve 32*a*. However, a partial water stream will be ejected through the purging perforation 328*a* to clean the screen 33 during the water pumping operation. The cross sectional area of the perforation 328*a* should be greatly smaller than that of the flushing pipe 34**.

Figure 5:
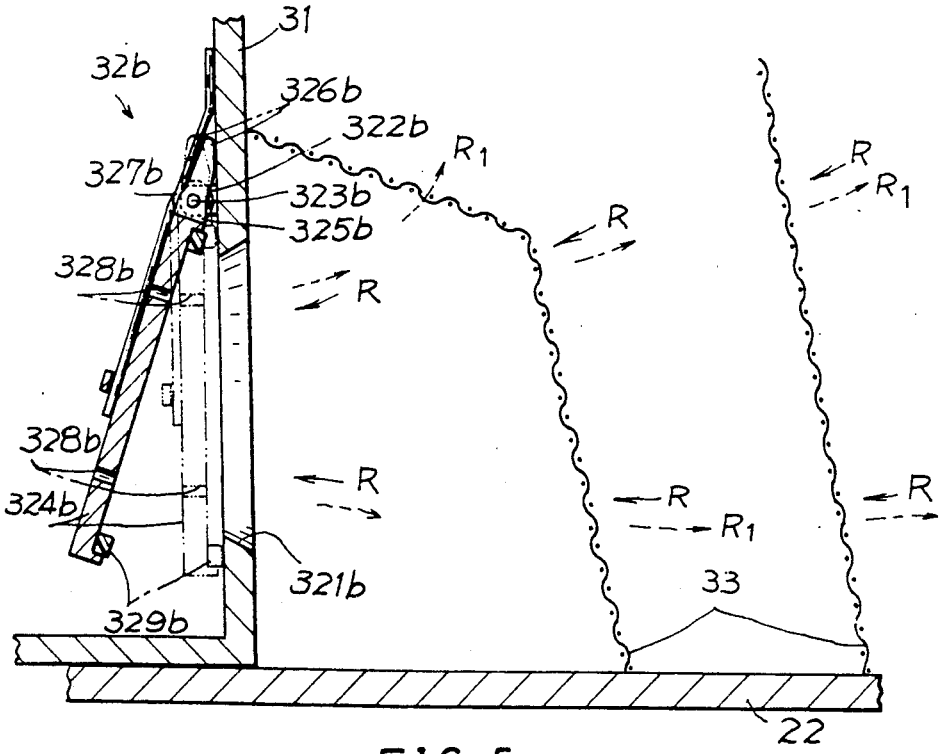
FIG. 5 shows still another preferred embodiment of the feed water vlave of the present invention.

Still another preferred embodiment of the feed water valve **32*b* is shown in FIG. 5, which includes: an inlet port 321*b* formed in a lower portion of the flushing water tank 31, a valve disc 324*b* having a lug 325*b* pivotally mounted on a bracket 322*b* formed above the port 321*b* by a pivot 323*b* and having a limiting plate 326*b* protruding upwardly to be retarded against the tank wall when the disc 324*b* is biased and opened, and a restoring spring 327*b* secured on the disc 324*b* and the tank wall normally biasing the disc 324*b* to open the port 321*b* for directing filtered water into the flushing tank 31. The disc 324*b* is formed with at least a purging perforation 328*b* therein for purging and cleaning the filtering screen 33 to prevent clogging of the waste particulate on the screen 33. A packing member 329*b* may also be formed on a periphery of the disc 324*b* for sealing the port 321*b*** under boosting pressure.

The present invention has the following advantages superior to a conventional filter and pump assembly of recirculating sanitary system:

1. There is not provided with any diaphragm pump in this invention since the filtered water may be easily boosted for flushing the toilet merely by applying a compressed air in the flushing tank 31 so that the construction of this invention is so simple to thereby reduce the installation cost and minimize maintenance problems.

2. The screens 33 are provided for filtering off particulate matters laden in the water to prevent serious contamination or clogging on other elements of the recirculating system.

3. This invention is suitable either for big system or small system, depending upon the water quantity required for flushing any specific toilet.

I claim:

1. A recirculating toilet water system comprising:

a toilet;

a main water tank positioned under the toilet for receiving waste matters discharged from the toilet and filled with water in said water tank;

a filtered water supply means including a flushing water tank fixed in said main water tank having a flushing pipe connected between said flushing water tank and said toilet for delivering filtered water as filtered through at least a screen provided between said flushing water tank and said main water tank, and a feed water valve formed in said flushing water tank normally opened for directing filtered water through said screen provided beyond said valve and operatively closed for allowing a major water stream flowing through said flushing pipe for flushing said toilet, said feed water valve having at least a purging perforation formed in said valve for ejecting a partial water stream through said perforation for expelling particulate matters clogged on said screen when subject to a boosting pressure in said flushing water tank; and an air supply means including an air delivery pipe for directing compressed air into said flushing water tank for boosting the filtered water for flushing the toilet and for purging the screen;

the improvement which comprises:

said feed water valve including: a valve body fixed in a lower portion of said flushing water tank defining a front inlet port formed in a front end portion of said valve body, a middle outlet port formed in a middle portion of said valve body and a rear purging port formed in a rear end portion of said valve body; a plunger reciprocatively held in said valve body; and a restoring spring retained between a front portion of said plunger and a front portion of said valve body; said plunger including; a water passage formed in said plunger normally communicated with said inlet port and said outlet port of said valve body for directing filtered water from said main water tank into said flushing water tank; a solid rear portion formed on a rear portion of said plunger normally sealing said rear purging port of said valve body as urged rearwardly by said restoring spring for matching said water passage in said plunger with said outlet port of said valve body for normally directing filtered water into said flushing water tank, and operatively closing said outlet port of said valve body when frontwardly urged by a boosting pressure of the compressed air of said air supply means for boosting water into said toilet through said flushing pipe; and said purging perforation formed through said solid rear portion communicated with said water passage of said plunger and said inlet port of said valve body for ejecting a partial water stream for purging said screen for expelling particulate matters clogged on said screen when subject to a boosting pressure by the compressed air of said air supply means in said flushing water tank.

2. A recirculating toilet water system comprising:

a toilet;

a main water tank positioned under the toilet for receiving waste matters discharged from the toilet and filled with water in said water tank;

a filtered water supply means including a flushing water tank fixed in said main water tank having a flushing pipe connected between said flushing water tank and said toilet for delivering filtered water as filtered through at least a screen provided between said flushing water tank and said main water tank, and a feed water valve formed in said flushing water tank normally opened for directing filtered water through said screen provided beyond said valve and operatively closed for allowing a major water stream flowing through said flushing pipe for flushing said toilet, said feed water valve having at least a purging perforation formed in said valve for ejecting a partial water stream through said perforation for expelling particulate matters clogged on said screen when subject to a boosting pressure in said flushing water tank; and an air supply means including an air delivery pipe for directing compressed air into said flushing water tank for boosting the filtered water for flushing the toilet and for purging the screen;

the improvement which comprises:

said feed water valve including a valve body generally formed as a cylindrical sleeve fixed in said flushing water tank, a valve stem reciprocating in said cylindrical sleeve of said valve body, a valve disc fixed on a rear end of said valve stem normally opened for opening an inlet port disposed around said valve body as urged by a restoring spring normally urging said valve disc rearwardly for directing filtered water from said main water tank into said flushing water tank, said valve disc having said purging perforation formed therein, Whereby upon a boosting of a compressed air from the air supply means to urge said valve disc frontwardly to close said inlet port, the filtered water in said flushing water tank is boosted and pumped through said flushing pipe for flushing the toilet, and a partial water stream is ejected through said purging perforation to clean said screen.

3. A recirculating toilet water system comprising:

a toilet;

a main water tank positioned under the toilet for receiving waste matters discharged from the toilet and filled with water in said water tank;

a filtered water supply means including a flushing water tank fixed in said main water tank having a flushing pipe connected between said flushing water tank and said toilet for delivering filtered water as filtered through at least a screen provided between said flushing water tank and said main water tank, and a feed water valve formed in said flushing water tank normally opened for directing filtered water through said screen provided beyond said valve and operatively closed for allowing a major water stream flowing through said flushing pipe for flushing said toilet, said feed water valve having at least a purging perforation formed in said valve for ejecting a partial water stream through said perforation for expelling particulate matters clogged on said screen when subject to a boosting pressure in said flushing water tank; and an air supply means directing compressed air into said flushing water tank for boosting the filtered water for flushing the toilet and for purging the screen;

the improvement which comprises:

said feed water valve including a valve disc pivotally mounted on a tank wall of said flushing water tank above an inlet port and normally biased to open said inlet port as rearwardly urged by a restoring spring secured between said disc and said tank wall for directing filtered water from said main water tank into said flushing water tank, said valve disc having said purging perforation formed therein, whereby upon a boosting of a compressed air from the air supply means to urge said valve disc frontwardly to close said inlet port, the filtered water in said flushing water tank is boosted and pumped through said flushing pipe for flushing the toilet, and a partial water stream is ejected through said purging perforation to clean said screen.

* * * * *